US010384096B1

(12) United States Patent
Aery

(10) Patent No.: US 10,384,096 B1
(45) Date of Patent: Aug. 20, 2019

(54) WEIGHT ASSEMBLY AND ASSOCIATED USE THEREOF

(71) Applicant: Christopher Aery, Riverhead, NY (US)

(72) Inventor: Christopher Aery, Riverhead, NY (US)

( * ) Notice: Subject to any disclaimer, the term of this patent is extended or adjusted under 35 U.S.C. 154(b) by 0 days.

(21) Appl. No.: 16/185,764

(22) Filed: Nov. 9, 2018

Related U.S. Application Data

(60) Provisional application No. 62/583,833, filed on Nov. 9, 2017.

(51) Int. Cl.

| | |
|---|---|
| ***A63B 21/22*** | (2006.01) |
| ***A63B 21/072*** | (2006.01) |
| ***A63B 23/12*** | (2006.01) |
| ***A63B 21/00*** | (2006.01) |
| ***A63B 21/075*** | (2006.01) |

(52) U.S. Cl.
CPC ..... *A63B 21/22* (2013.01); *A63B 21/075* (2013.01); *A63B 21/0728* (2013.01); *A63B 21/4035* (2015.10); *A63B 23/1209* (2013.01)

(58) Field of Classification Search
CPC ..... A63B 21/02; A63B 21/07; A63B 23/12; A63B 21/40
See application file for complete search history.

(56) References Cited

U.S. PATENT DOCUMENTS 4,618,142 A * 10/1986 Joseph, Jr. ..... A63B 5/20 482/106
4,709,922 A * 12/1987 Slade, Jr. ..... A63B 21/0783 482/104
4,998,721 A * 3/1991 Anders ..... A63B 21/0783 482/4
4,998,723 A * 3/1991 Santoro ..... A63B 21/078 482/104
5,029,849 A * 7/1991 Nurkowski ..... A63B 21/072 482/106
5,310,394 A * 5/1994 Kallios ..... A63B 21/00181 482/104
5,823,921 A * 10/1998 Dawson ..... A63B 21/00181 482/104
5,871,423 A * 2/1999 Pruchnik ..... A63B 21/22 482/1
5,891,004 A * 4/1999 Berry ..... A63B 21/04 482/106
5,989,164 A * 11/1999 Kullman ..... A63B 21/0783 482/104
6,261,211 B1 * 7/2001 Suarez ..... A63B 21/0603 482/107

(Continued)

*Primary Examiner* — Garrett K Atkinson
(74) *Attorney, Agent, or Firm* — Ashkan Najafi

(57) ABSTRACT

A weight assembly includes a barbell having a centrally registered longitudinal axis having a center point, a central section aligned with the axis, a first lateral end and a second lateral end spaced apart at opposed ends of the central section, a first collar statically coupled to the first lateral end, and a second collar statically coupled to the second lateral end, wherein the plurality of spools are coaxially aligned with the barbell. A plurality of hand grips are statically disposed at the central section and abutted against the first collar and the second collar, respectively, and a plurality of spools statically disposed at the central section and abutted against the plurality of hand grips, respectively. A plurality of tethers are rotatably wound about the plurality of spools, respectively, and a plurality of weights interchangeably engaged with the barbell and the plurality of spools, respectively.

19 Claims, 5 Drawing Sheets

(56) References Cited

U.S. PATENT DOCUMENTS

| | | | | |
|---|---|---|---|---|
| 6,293,892 | B1 * | 9/2001 | Slawinski | A63B 21/00181 482/104 |
| 6,379,287 | B1 * | 4/2002 | Slawinski | A63B 21/00181 482/104 |
| 6,648,804 | B2 * | 11/2003 | Chen | A63B 21/0004 482/125 |
| 6,893,381 | B2 * | 5/2005 | Slawinski | A63B 21/078 482/104 |
| 6,926,649 | B2 * | 8/2005 | Slawinski | A63B 21/00181 482/104 |
| 7,753,827 | B1 * | 7/2010 | Emick | A63B 21/00181 482/44 |
| 8,444,537 | B1 * | 5/2013 | Santoro | A63B 21/078 482/104 |
| 8,784,281 | B2 * | 7/2014 | Johnson, III | A63B 21/0783 482/104 |
| 9,126,079 | B2 * | 9/2015 | Jordan | A63B 21/072 |
| 9,884,239 | B2 * | 2/2018 | Kay | A63B 21/153 |
| 2002/0198081 | A1 * | 12/2002 | Chen | A63B 21/0004 482/23 |
| 2007/0179030 | A1 * | 8/2007 | Slawinski | A63B 21/00181 482/98 |
| 2007/0287609 | A1 * | 12/2007 | McBride | A63B 21/065 482/105 |
| 2012/0244999 | A1 * | 9/2012 | Tauriainen | A63B 21/078 482/104 |
| 2013/0190143 | A1 * | 7/2013 | Greenhill | A63B 21/0058 482/104 |
| 2014/0018214 | A1 * | 1/2014 | Jordan | A63B 21/072 482/107 |
| 2014/0073493 | A1 * | 3/2014 | Parish | A63B 21/0724 482/104 |
| 2016/0263461 | A1 * | 9/2016 | Kay | A63B 21/0783 |
| 2017/0021223 | A1 * | 1/2017 | Ramsey | A63B 21/0724 |

* cited by examiner

WEIGHT ASSEMBLY AND ASSOCIATED USE THEREOF

CROSS REFERENCE TO RELATED APPLICATIONS

This is a non-provisional patent application that claims the benefit of U.S. provisional patent application No. 62/583,833 filed Nov. 9, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to exercise equipment and, more particularly, to a weight assembly including a barbell fitted with two attachable hanging weights which are rolled up and down around spools as the barbell is turned, using the rubberized hand grips, thereby providing weight trainers with a unique new means of achieving an all-around optimal workout. Working the hands, wrists, and forearms, this two-in-one barbell can also be used in a conventional manner, working the biceps, triceps, lats, pecs, and more.

Prior Art

There is little dispute that regular exercise is extremely beneficial to the human body. Whether an elderly couple embarking on an evening stroll, a health-conscious coed enjoying an afternoon aerobics class, or a homemaker stretching her muscles and raising her heartbeat through yoga, regularly exercise is beneficial to the body, mind, and spirit. In particular, millions of consumers enjoy sculpting and toning their body through the use of weight training. Free weights are offered in a variety of sizes, with various weights accommodating beginning exercise enthusiasts to skilled body builders alike. Helping to burn excess fat and build stronger muscles, regular weight training can increase endurance, as well as facilitate a healthier physical appearance. This form of exercise is so beneficial that many experts believe that weight exercise can even help consumers postpone many of the effects of aging, such as osteoporosis. Ideal for those who wish to sculpt and tone their bodies, weight training is also a proven method of rebuilding muscle groups after illness or injury.

Accordingly, a need remains for weight assembly in order to overcome at least one of the above-noted shortcomings. The exemplary embodiment(s) satisfy such a need by a weight assembly including a barbell fitted with two attachable hanging weights which are rolled up and down around spools as the barbell is turned, using the rubberized hand grips, that is convenient and easy to use, lightweight yet durable in design, versatile in its applications, and designed for providing weight trainers with a unique new means of achieving an all-around optimal workout. Working the hands, wrists, and forearms, this two-in-one barbell can also be used in a conventional manner, working the biceps, triceps, lats, pecs, and more.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a weight assembly including a barbell fitted with two attachable hanging weights which are rolled up and down around spools as the barbell is turned, using the rubberized hand grips, thereby providing weight trainers with a unique new means of achieving an all-around optimal workout. Working the hands, wrists, and forearms, this two-in-one barbell can also be used in a conventional manner, working the biceps, triceps, lats, pecs, and more. These and other objects, features, and advantages of the non-limiting exemplary embodiment(s) are provided by a weight assembly for providing a workout including a barbell including a centrally registered longitudinal axis having a center point, a central section aligned with the centrally registered longitudinal axis, a first lateral end and a second lateral end spaced apart at opposed ends of the central section, a first collar statically coupled to the first lateral end, and a second collar statically coupled to the second lateral end, wherein the plurality of spools are coaxially aligned with the barbell. The weight assembly further includes a plurality of hand grips statically disposed at the central section and abutted against the first collar and the second collar, respectively, and a plurality of spools statically disposed at the central section and abutted against the plurality of hand grips, respectively. The weight assembly further includes a plurality of tethers rotatably wound about the plurality of spools, respectively, and a plurality of weights interchangeably engaged with the barbell and the plurality of spools, respectively. Advantageously, the plurality of tethers are configured to roll-up and roll-down the plurality of weights about the plurality of spools as the barbell is rotated in opposite rotational directions about the centrally registered longitudinal axis, respectively.

In a non-limiting exemplary embodiment, the plurality of tethers includes associated distal ends including a plurality of fasteners fixedly coupled thereto, respectively. Advantageously, the plurality of fasteners are adjustably engaged to non-distal ends of the plurality of tethers such that the distal ends of the plurality of tethers are looped through the plurality of weights. Any suitable type of fastener may be employed such as a carabiner, hook, latch, clip, etc., without departing from the true spirit and scope of the present disclosure.

In a non-limiting exemplary embodiment, the central section, the first lateral end, and the second lateral end are axially aligned along the centrally registered longitudinal axis.

In a non-limiting exemplary embodiment, the hand grips include a first hand grip and a second hand grip extended medially toward the center point.

In a non-limiting exemplary embodiment, the first collar and the second collar are equidistantly spaced apart from the center point.

In a non-limiting exemplary embodiment, the plurality of spools includes a first spool and a second spool directly engaged with the first hand grip and the second hand grip, respectively.

In a non-limiting exemplary embodiment, the plurality of tethers includes a first tether and a second tether independently wound about the first spool and the second spool, respectively.

In a non-limiting exemplary embodiment, the plurality of weights are selectively disengaged from the first lateral end and the second lateral end, respectively, and selectively attached to the first spool and the second spool, respectively.

In a non-limiting exemplary embodiment, the first spool and the second spool are configured to contemporaneously rotate in sync when the barbell is rotated.

The present disclosure further includes a method of utilizing a weight assembly for providing a workout. Such a method includes the initial step of: providing a barbell including a centrally registered longitudinal axis having a center point, a central section aligned with the centrally registered longitudinal axis, a first lateral end and a second lateral end spaced apart at opposed ends of the central section, a first collar statically coupled to the first lateral end, and a second collar statically coupled to the second lateral end, wherein the plurality of spools are coaxially aligned with the barbell.

The method further includes the steps of: providing and statically disposing a plurality of hand grips at the central section; abutting the plurality of hand grips against the first collar and the second collar, respectively; providing and disposing a plurality of spools statically at the central section; abutting the plurality of spools against the plurality of hand grips, respectively; providing and rotatably winding a plurality of tethers about the plurality of spools, respectively; providing and interchangeably engaging a plurality of weights from the barbell to the plurality of spools, respectively; and rotating the barbell in opposite rotational directions about the centrally registered longitudinal axis such that the plurality of tethers roll-up and roll-down the plurality of weights about the plurality of spools, respectively.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
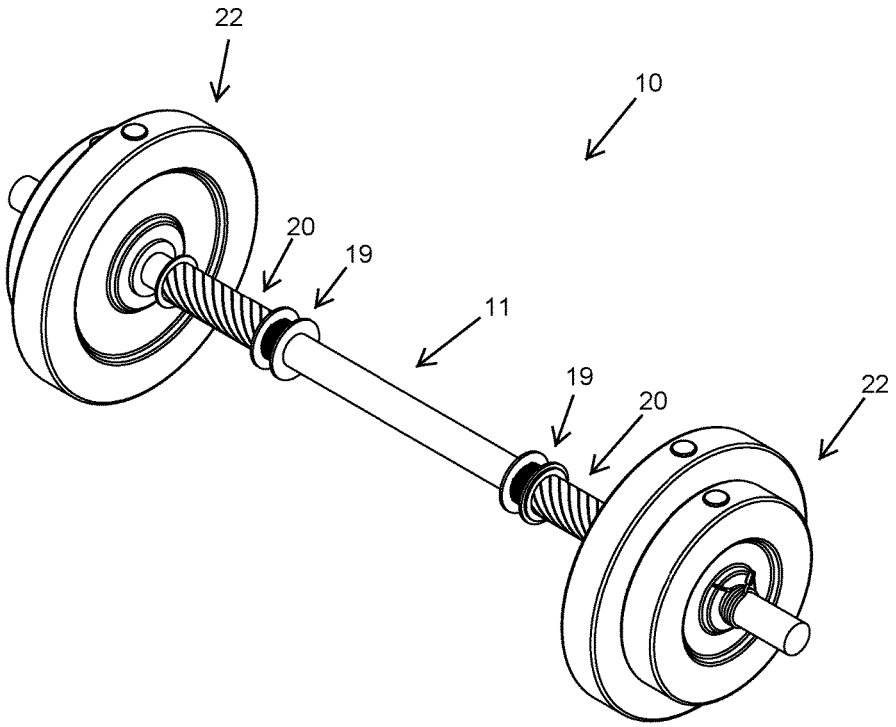
FIG. 1 is a perspective view of a weight assembly wherein the weights are attached directly to opposed lateral ends of the barbell, in accordance with a non-limiting exemplary embodiment of the present disclosure.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

Figure 2:
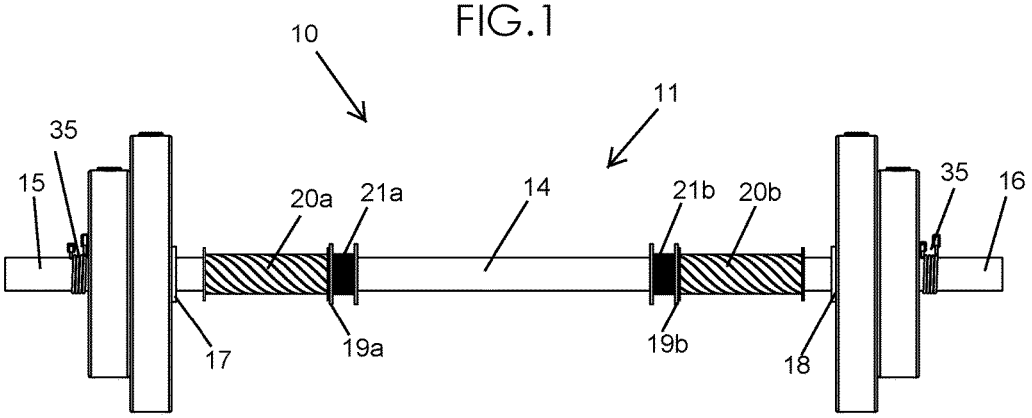
FIG. 2 is a front elevational view of the weight assembly shown in FIG. 1.
Figure 3:
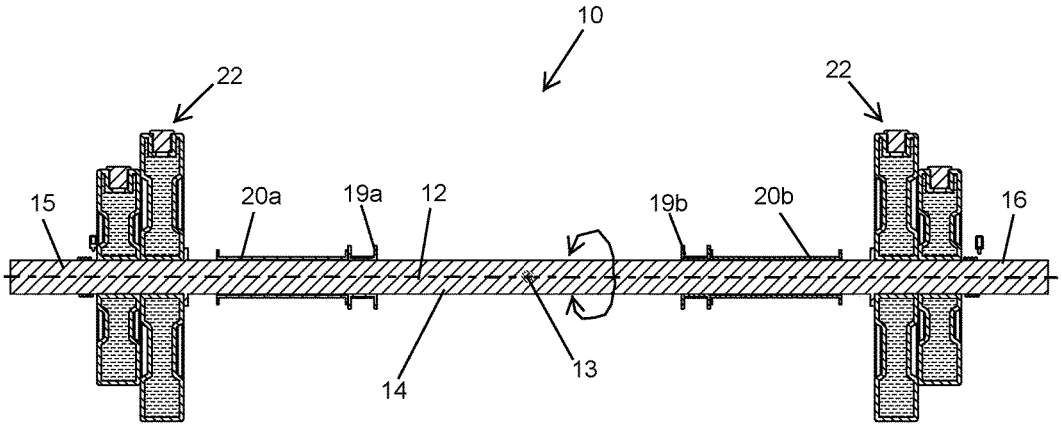
FIG. 3 is a cross-sectional view taken along line 3-3 in FIG. 2.
Figure 4:
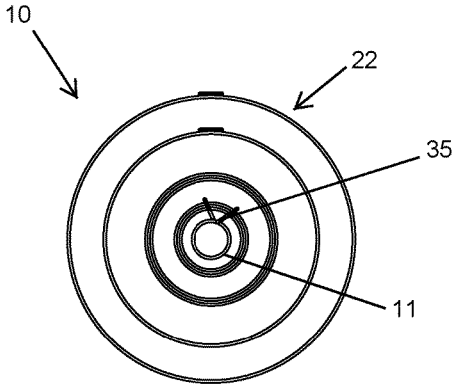
FIG. 4 is a side elevational view of the weight assembly shown in FIG. 1.
Figure 5:
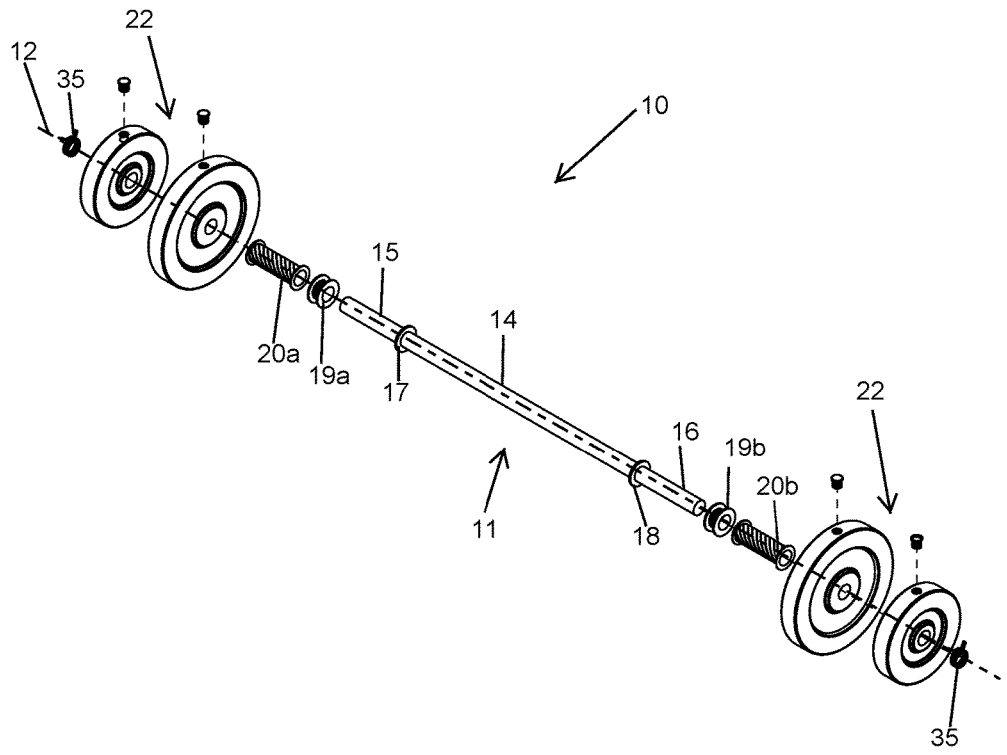
FIG. 5 is an exploded view of the weight assembly shown in FIG. 1.
Figure 6:
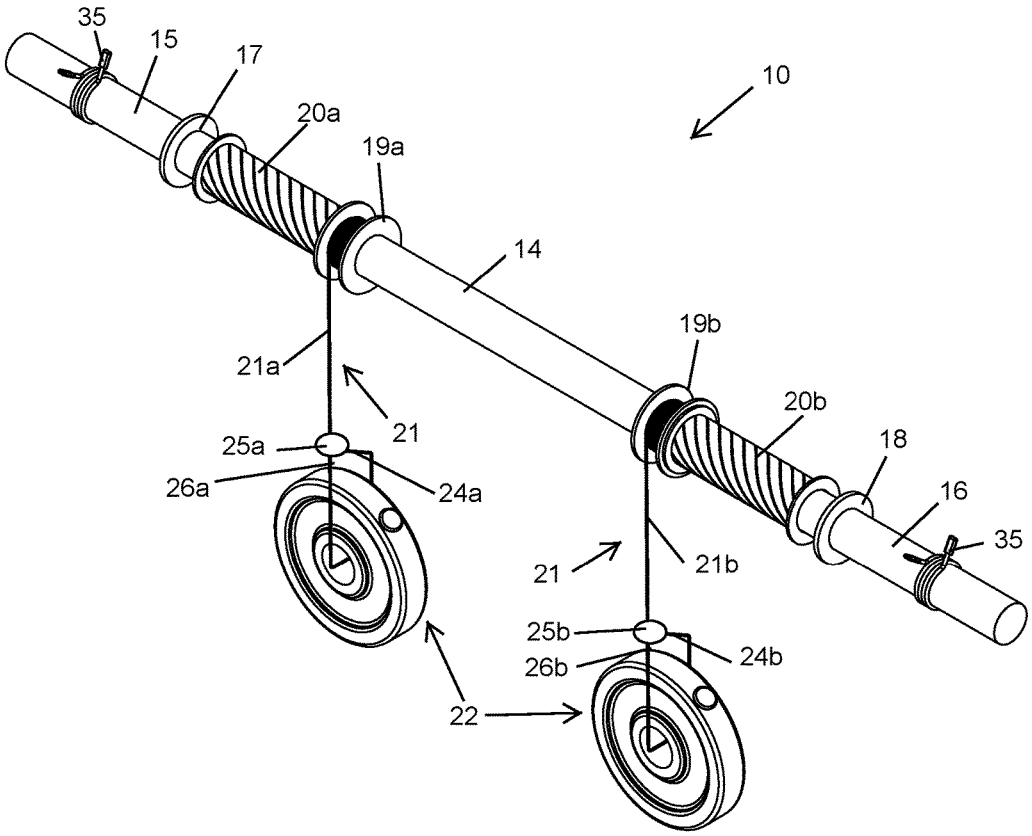
FIG. 6 is a perspective view of the weight assembly shown in FIG. 1 wherein the weights are removed from opposed lateral ends of the barbell and attached directly to the tethers.
Figure 7:
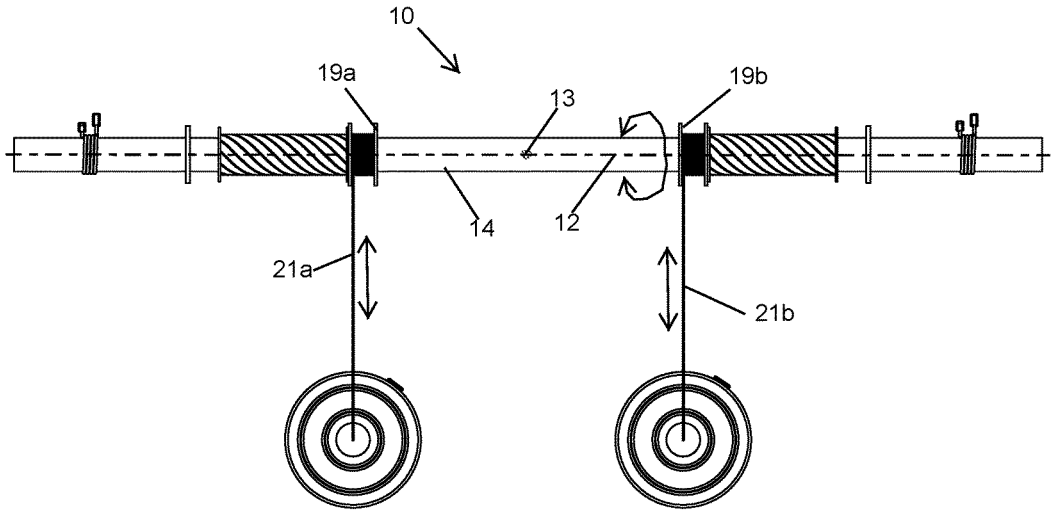
FIG. 7 is a reduced front elevational view of the weight assembly shown in FIG. 6.
Figure 8:
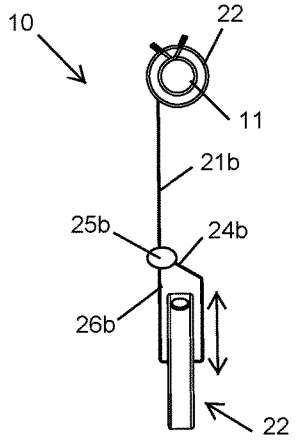
FIG. 8 is a reduced side elevational view of the weight assembly shown in FIG. 6.

The non-limiting exemplary embodiment(s) is/are referred to generally in FIGS. 1-8 and is/are intended to provide a weight assembly 10 including a barbell 11 fitted with two attachable hanging weights (collectively at 22) which are rolled up and down around spools (collectively at 19) as the barbell 11 is turned, using the rubberized hand grips (collectively at 20), thereby providing weight trainers with a unique new means of achieving an all-around optimal workout. Working the hands, wrists, and forearms, this two-in-one barbell 11 can also be used in a conventional manner, working the biceps, triceps, lats, pecs, and more. It should be understood that the exemplary embodiment(s) may be used to perform a variety of exercises and should not be limited to any particular exercise described herein.

The weight assembly 10 includes a barbell 11 having a centrally registered longitudinal axis 12 having a center point 13, a central section 14 aligned with the centrally registered longitudinal axis 12, a first lateral end 15 and a second lateral end 16 spaced apart at opposed ends of the central section 14, a first collar 17 statically coupled to the first lateral end 15, and a second collar 18 statically coupled to the second lateral end 16, wherein the plurality of spools (collectively at 19) are coaxially aligned with the barbell 11. The weight assembly 10 further includes a plurality of hand grips (collectively at 20) statically disposed at the central section 14 and abutted against the first collar 17 and the second collar 18, respectively, and a plurality of spools (collectively at 19) statically disposed at the central section 14 and abutted against the plurality of hand grips (collectively at 20), respectively. The weight assembly 10 further includes a plurality of tethers (collectively at 21) rotatably wound about the plurality of spools (collectively at 19), respectively, and a plurality of weights (collectively at 22) interchangeably engaged with the barbell 11 and the plurality of spools (collectively at 19), respectively. Advantageously, the plurality of tethers (collectively at 21) are configured to roll-up and roll-down the plurality of weights (collectively at 22) about the plurality of spools (collectively at 19) as the barbell 11 is rotated in opposite rotational directions (e.g., clockwise and counter clockwise) about the centrally registered longitudinal axis 12, respectively.

In a non-limiting exemplary embodiment, the plurality of tethers (collectively at 21) includes associated distal ends 24*a*, 24*b* including a plurality of fasteners 25*a*, 25*b* fixedly coupled thereto, respectively. Advantageously, the plurality of fasteners 25*a*, 25*b* are adjustably engaged to non-distal ends 26*a*, 26*b* of the plurality of tethers (collectively at 21) such that the distal ends 24*a*, 24*b* of the plurality of tethers (collectively at 21) are looped through the plurality of weights (collectively at 22). In this manner, the weights (collectively at 22) are suspended below the barbell 11 via the tethers (collectively at 21). Any suitable type of fastener may be employed such as a carabiner, hook, latch, clip, etc., without departing from the true spirit and scope of the present disclosure.

In a non-limiting exemplary embodiment, the central section 14, the first lateral end 15, and the second lateral end 16 are axially aligned along the centrally registered longitudinal axis 12.

In a non-limiting exemplary embodiment, the hand grips (collectively at 20) include a first hand grip 20*a* and a second hand grip 20*b* each extended medially toward the center point 13.

In a non-limiting exemplary embodiment, the first collar 17 and the second collar 18 are equidistantly spaced apart from the center point 13.

In a non-limiting exemplary embodiment, the plurality of spools (collectively at 19) includes a first spool 19*a* and a second spool 19*b* directly engaged with the first hand grip 20*a* and the second hand grip 20*b*, respectively.

In a non-limiting exemplary embodiment, the plurality of tethers (collectively at 21) includes a first tether 21*a* and a second tether 21*b* independently wound about the first spool 19*a* and the second spool 19*b*, respectively.

In a non-limiting exemplary embodiment, the plurality of weights (collectively at 22) are selectively disengaged from the first lateral end 15 and the second lateral end 16, respectively, and selectively attached to the first spool 19*a* and the second spool 19*b*, respectively.

In a non-limiting exemplary embodiment, the first spool 19*a* and the second spool 19*b* are configured to contemporaneously rotate in sync when the barbell 11 is rotated in clockwise and counter clockwise directions.

The present disclosure further includes a method of utilizing a weight assembly 10 for providing a workout. Such a method includes the initial step of: providing a barbell 11 including a centrally registered longitudinal axis 12 having a center point 13, a central section 14 aligned with the centrally registered longitudinal axis 12, a first lateral end 15 and a second lateral end 16 spaced apart at opposed ends of the central section 14, a first collar 17 statically coupled to the first lateral end 15, and a second collar 18 statically coupled to the second lateral end 16, wherein the plurality of spools (collectively at 19) are coaxially aligned with the barbell 11.

The method further includes the steps of: providing and statically disposing a plurality of hand grips (collectively at 20) at the central section 14; abutting the plurality of hand grips (collectively at 20) against the first collar 17 and the second collar 18, respectively; providing and disposing a plurality of spools (collectively at 19) statically at the central section 14; abutting the plurality of spools (collectively at 19) against the plurality of hand grips (collectively at 20), respectively; providing and rotatably winding a plurality of tethers (collectively at 21) about the plurality of spools (collectively at 19), respectively; providing and interchangeably engaging a plurality of weights (collectively at 22) from the barbell 11 to the plurality of spools (collectively at 19), respectively (thus the weights (collectively at 22) are removed from the barbell 11 and attached to the tethers (collectively at 21)); and rotating the barbell 11 in opposite rotational directions (e.g., clockwise and counter clockwise)

about the centrally registered longitudinal axis 12 such that the plurality of tethers (collectively at 21) roll-up and roll-down the plurality of weights (collectively at 22) about the plurality of spools (collectively at 19), respectively.

Referring to FIGS. 1-8 in general, in a non-limiting exemplary embodiment(s), the weight assembly 10 includes a standard barbell 11 accented with two (2) weights (collectively at 22) that retract up and down as the barbell 11 is lifted and curled. In this manner, a user adds an exciting new dimension to their weight lifting. Fashioned of a durable, heavy duty metal material such as aluminum with a chrome finish, the weight assembly 10 measures approximately thirty-six inches (36") in length. At each end, a rubberized bicycle grip is provided for a secure yet comfortable hold while the product is in use. On the outside of these grips, where weights (collectively at 22) are typically placed, is a coil of rope-like cord (tethers 21) extending around twenty-eight inches (28") in length. The ropes are affixed to the barbell via associated spools (collectively at 19). Alternately, in another embodiment, the ropes may affixed to the barbell 11 via a durable alligator clip.

At the distal end of the rope, weights (collectively at 22) created specifically for the weight assembly 10 are provided. Fabricated of a polyurethane material, these circular units are filled with water by the user and start at a weight of 2.5 pounds. Additional weights (collectively at 22) are made available to accommodate users of varying statures and fitness levels. Relatively simple in design yet extremely effective in application, use of the weight assembly 10 is very easy and straightforward. A weight trainer secures a pair of spools 19 to the barbell 11 or, alternately, clips to the bar 11.

After the desired amount of weight is secured to each of the ropes, the user is ready to engage in bench presses or any desired rep exercise, deftly lifting the weight assembly 10 with both hands. When this occurs, the weights (collectively at 22) are able to roll-up and down with the rotational motion of barbell 11, extending down and retracting upward. Clips 35 are used to keep the weights 22 at the opposed lateral ends of the barbell 11.

The weight assembly 10 is a clever product which offers consumers many significant benefits and advantages. Foremost, this creatively designed accessory provides weight trainers with a unique new means of achieving a more versatile workout. Universal connectors that allow movable weights (collectively at 22) to be securely affixed to a barbell 11 via clips 35 or via spools/tethers can be employed. The weight assembly 10 allows users to enjoy versatility without having to purchase a vast array of expensive weight plates. While saving consumers money, the weight assembly 10 also frees much needed space in already-crowded workout areas.

An accessory that creates fully functional weights (collectively at 22), the weight assembly 10 enables the user to complete a wide variety of strength training, sculpting, and toning exercises in a safe and comfortable manner. Not just for household use, gym establishments will also appreciate the money- and space-savings afforded by this exciting product. Durably constructed of quality materials, the weight assembly 10 will withstand years of repeated use.

Providing a simple, cost-effective, and safe means of exercising with weights (collectively at 22), the weight assembly 10 is an innovative product which is an invaluable commodity in any professional or home gym. Simple to use, this product is quickly mastered by any consumers concerned with taking care of their body. Affordably priced, the weight assembly 10 is well-received by any exercise enthusiast, as well as the owners and operators of gyms and other athletic clubs, a very sizable market potential.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A weight assembly for providing a workout, said weight assembly comprising:

a barbell including a centrally registered longitudinal axis having a center point, a central section aligned with the centrally registered longitudinal axis, a first lateral end and a second lateral end spaced apart at opposed ends of said central section, a first collar coupled to said first lateral end, and a second collar coupled to said second lateral end;

a plurality of hand grips disposed at said central section and abutted against said first collar and said second collar, respectively;

a plurality of spools disposed at said central section and abutted against said plurality of hand grips, respectively;

a plurality of tethers rotatably wound about said plurality of spools, respectively; and a plurality of weights interchangeably engaged with said barbell and said plurality of spools, respectively;

wherein said plurality of tethers are configured to roll-up and roll-down said plurality of weights about said plurality of spools as said barbell is rotated in opposite rotational directions about the centrally registered longitudinal axis, respectively.

2. The weight assembly of claim 1, wherein said plurality of tethers comprise: associated distal ends including a plurality of fasteners fixedly coupled thereto, respectively;

wherein said plurality of fasteners are adjustably engaged to non-distal ends of said plurality of tethers such that said distal ends of said plurality of tethers are looped through said plurality of weights.

3. The weight assembly of claim 2, wherein said central section, said first lateral end, and said second lateral end are axially aligned along the centrally registered longitudinal axis.

4. The weight assembly of claim 3, wherein said hand grips comprise: a first hand grip and a second hand grip extended medially toward said center point.

5. The weight assembly of claim 4, wherein said first collar and said second collar are equidistantly spaced apart from said center point.

6. The weight assembly of claim 5, wherein said plurality of spools comprises: a first spool and a second spool directly engaged with said first hand grip and said second hand grip, respectively.

7. The weight assembly of claim 6, wherein said plurality of tethers comprises: a first tether and a second tether independently wound about said first spool and said second spool, respectively.

8. The weight assembly of claim 7, wherein said plurality of weights are selectively disengaged from said first lateral end and said second lateral end, respectively, and selectively attached to said first spool and said second spool, respectively.

9. The weight assembly of claim 8, wherein said first spool and said second spool are configured to contemporaneously rotate in sync when said barbell is rotated.

10. A weight assembly for providing a workout, said weight assembly comprising:

a barbell including a centrally registered longitudinal axis having a center point, a central section aligned with the centrally registered longitudinal axis, a first lateral end and a second lateral end spaced apart at opposed ends of said central section, a first collar statically coupled to said first lateral end, and a second collar statically coupled to said second lateral end;

a plurality of hand grips statically disposed at said central section and abutted against said first collar and said second collar, respectively;

a plurality of spools statically disposed at said central section and abutted against said plurality of hand grips, respectively;

a plurality of tethers rotatably wound about said plurality of spools, respectively; and a plurality of weights interchangeably engaged with said barbell and said plurality of spools, respectively;

wherein said plurality of tethers are configured to roll-up and roll-down said plurality of weights about said plurality of spools as said barbell is rotated in opposite rotational directions about the centrally registered longitudinal axis, respectively;

wherein said plurality of spools are coaxially aligned with said barbell.

11. The weight assembly of claim 10, wherein said plurality of tethers comprise: associated distal ends including a plurality of fasteners fixedly coupled thereto, respectively;

wherein said plurality of fasteners are adjustably engaged to non-distal ends of said plurality of tethers such that said distal ends of said plurality of tethers are looped through said plurality of weights.

12. The weight assembly of claim 11, wherein said central section, said first lateral end, and said second lateral end are axially aligned along the centrally registered longitudinal axis.

13. The weight assembly of claim 12, wherein said hand grips comprise: a first hand grip and a second hand grip extended medially toward said center point.

14. The weight assembly of claim 13, wherein said first collar and said second collar are equidistantly spaced apart from said center point.

15. The weight assembly of claim 14, wherein said plurality of spools comprises: a first spool and a second spool directly engaged with said first hand grip and said second hand grip, respectively.

16. The weight assembly of claim 15, wherein said plurality of tethers comprises: a first tether and a second tether independently wound about said first spool and said second spool, respectively.

17. The weight assembly of claim 16, wherein said plurality of weights are selectively disengaged from said first lateral end and said second lateral end, respectively, and selectively attached to said first spool and said second spool, respectively.

18. The weight assembly of claim 17, wherein said first spool and said second spool are configured to contemporaneously rotate in sync when said barbell is rotated.

19. A method of utilizing a weight assembly for providing a workout, said method comprising the steps of:

providing a barbell including a centrally registered longitudinal axis having a center point, a central section aligned with the centrally registered longitudinal axis, a first lateral end and a second lateral end spaced apart at opposed ends of said central section, a first collar statically coupled to said first lateral end, and a second collar statically coupled to said second lateral end, wherein said plurality of spools are coaxially aligned with said barbell;

providing and statically disposing a plurality of hand grips at said central section;

abutting said plurality of hand grips against said first collar and said second collar, respectively;

providing and disposing a plurality of spools statically at said central section;

abutting said plurality of spools against said plurality of hand grips, respectively;

providing and rotatably winding a plurality of tethers about said plurality of spools, respectively;

providing and interchangeably engaging a plurality of weights from said barbell to said plurality of spools, respectively; and rotating said barbell in opposite rotational directions about the centrally registered longitudinal axis such that said plurality of tethers roll-up and roll-down said plurality of weights about said plurality of spools, respectively.

* * * * *